United States Patent [19]

Nakaya

[11] Patent Number: 4,962,307

[45] Date of Patent: Oct. 9, 1990

[54] CORONA DISCHARGING DEVICE

[75] Inventor: Masahide Nakaya, Chigasaki, Japan

[73] Assignee: Ricoh Company, Ltd., Tokyo, Japan

[21] Appl. No.: 340,534

[22] Filed: Apr. 19, 1989

[30] Foreign Application Priority Data

| | | | |
|---|---|---|---|
| Apr. 21, 1988 | [JP] | Japan | 63-98697 |
| Apr. 21, 1988 | [JP] | Japan | 63-98698 |
| Feb. 25, 1989 | [JP] | Japan | 1-44641 |

[51] Int. Cl.[5] ..... H01T 19/00

[52] U.S. Cl. ..... 250/324; 250/326; 250/325; 361/229

[58] Field of Search ..... 250/324, 325, 326; 361/229

[56] References Cited

U.S. PATENT DOCUMENTS

| | | | |
|---|---|---|---|
| 3,742,237 | 6/1973 | Barker | 250/324 |
| 3,961,193 | 6/1976 | Hudson | 250/324 |
| 4,339,783 | 7/1982 | Kinashi et al. | 250/324 |
| 4,446,371 | 5/1984 | Cobb | 250/324 |
| 4,456,825 | 6/1984 | Kuge et al. | 250/324 |
| 4,672,505 | 6/1987 | Tsuchiya | 250/324 |
| 4,700,261 | 10/1987 | Nagase et al. | 250/326 |
| 4,709,298 | 11/1987 | Hosono et al. | 250/326 |
| 4,783,716 | 11/1988 | Nagase et al. | 250/326 |

*Primary Examiner*—Jack I. Berman
*Assistant Examiner*—Kiet T. Nguyen
*Attorney, Agent, or Firm*—Oblon, Spivak, McClelland, Maier & Neustadt

[57] ABSTRACT

A corona discharging device for an electrophotographic copier, laser printer or similar image forming equipment of the type using an electrophotographic procedure. The device has a corona wire, a rear electrode, and a dielectric plate intervening between the corona wire and the rear electrode. A pulse voltage is applied across the corona wire and rear electrode, while a DC bias voltage is applied across the corona wire and a photoconductive element which is located in close proximity to the corona discharging device. A current for charging the photoconductive element is controlled to a predetermined constant value. When the charging current is lowered below a predetermined value or when the DC bias voltage is increased above a predetermined value or decreased below a predetermined value, a high-tension power supply stops feeding a high voltage by deciding that an output is open or short-circuited.

10 Claims, 13 Drawing Sheets

CORONA DISCHARGING DEVICE

BACKGROUND OF THE INVENTION

The present invention relates to a corona discharging device for an electrophotographic copier, laser printer or similar image forming equipment of the type using an electrophotographic procedure.

Image recording equipment of the type described has a corona discharging device for charging the surface of a photoconductive element which serves as an image carrier. The corona discharging device is implemented by a corona discharger such as a corotron or a scorotron. The corona discharger produces a corona discharge in response to a high voltage which is generated by a high-tension power supply. The output current of the power supply is controlled to remain constant so that the current for charging the photoconductive element may remain constant, whereby the charge potential on the element is stabilized against changes in ambient conditions such as temperature, humidity, and atmospheric pressure. Specifically, a prior art corona discharging device has a corona discharger which is made up of a corona wire and a shield electrode which surrounds the corona wire, that side of the shield electrode which faces a photoconductive element being open. A high-tension power supply applies a high voltage to the corona wire. The output current of the power supply is divided into a charging current for charging the photoconductive element and a shield electrode current which flows through the shield electrode. This brings about a drawback that when the division ratio, or distribution ratio, of the output current of the power supply is changed due to the contamination of the shield electrode, the charging current and therefore the charge potential on the photoconductive element changes despite that the output current is constant. Another drawback with the prior art device is that an air gap has to be provided between the corona wire and the shield electrode, obstructing the miniaturization of the corona discharger. Moreover, since the high voltage is fed to the corona wire even in an unusual condition of the equipment such as when one has forgotten to mount the photoconductive element, there is a fear of an electrical shock and an arc discharge between the corona wire and the shield electrode.

SUMMARY OF THE INVENTION

It is therefore an object of the present invention to provide a corona discharging device for image forming equipment which is capable of charging a photoconductive element stably at all times and, yet, miniature and durable.

It is another object of the present invention to provide a safe corona discharging device for image forming equipment apparatus which eliminates the fear of an electrical shock and an arc discharge even when a photoconductive element is not mounted in the equipment.

It is another object of the present invention to provide a generally improved corona discharging device.

A corona discharging device for image forming equipment having an image carrier of the present invention comprises a corona discharger located in close proximity to the image carrier and comprising a dielectric plate, a rear electrode positioned at one side of the dielectric plate, and a corona wire positioned at the other side of the dielectric plate, and a high-tension power supply for applying a DC bias voltage across the corona wire and image carrier and applying a pulse voltage which is opposite in polarity to the DC bias voltage across the rear electrode and corona wire.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
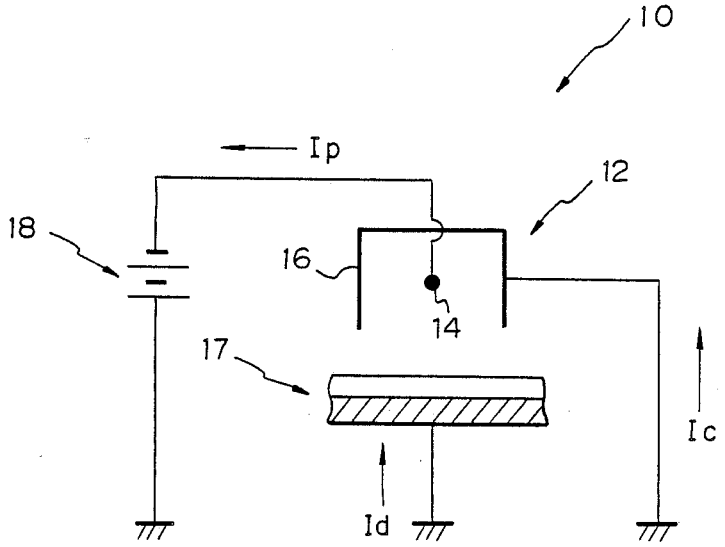
Fig. 1 PRIOR ART
FIG. 1 is a circuit diagram representative of a basic construction of a prior art corona discharging device.

To better understand the present invention, a brief reference will be made to a prior art corona discharging device, shown in FIG. 1. In the figure, a prior art corona discharging device, generally 10, has a corona discharger 12 which is made up of a corona wire 14 and a shield electrode 16 which surrounds the corona wire 14, that side of the shield electrode 16 which faces a photoconductive element 17 being open. A high-tension power supply 18 applies a high voltage to the corona wire 14. The output current Ip of the power supply 18 is divided into a charging current Id for charging the photoconductive element 17 and a shield electrode current Ic which flows through the shield electrode 16. This brings about a drawback that when the division ratio, or distribution ratio, of the output current Ip of the power supply 18 is changed due to the contamination of the shield electrode 16, the charging current Id and therefore the charge potential on the photoconductive element 17 changes despite that the output current Ip is constant. Another drawback with the prior art device 10 is that an air gap has to be provided between the corona wire 14 and the shield electrode 16, obstructing the miniaturization of the corona discharger 12. Moreover, since the high voltage is applied to the corona wire 14 even in an unusual condition of the equipment such as when one has forgotten to mount the photoconductive element 17, there is a fear of an electrical shock and an arc discharge between the corona wire 14 and the shield electrode 16.

Figure 2:
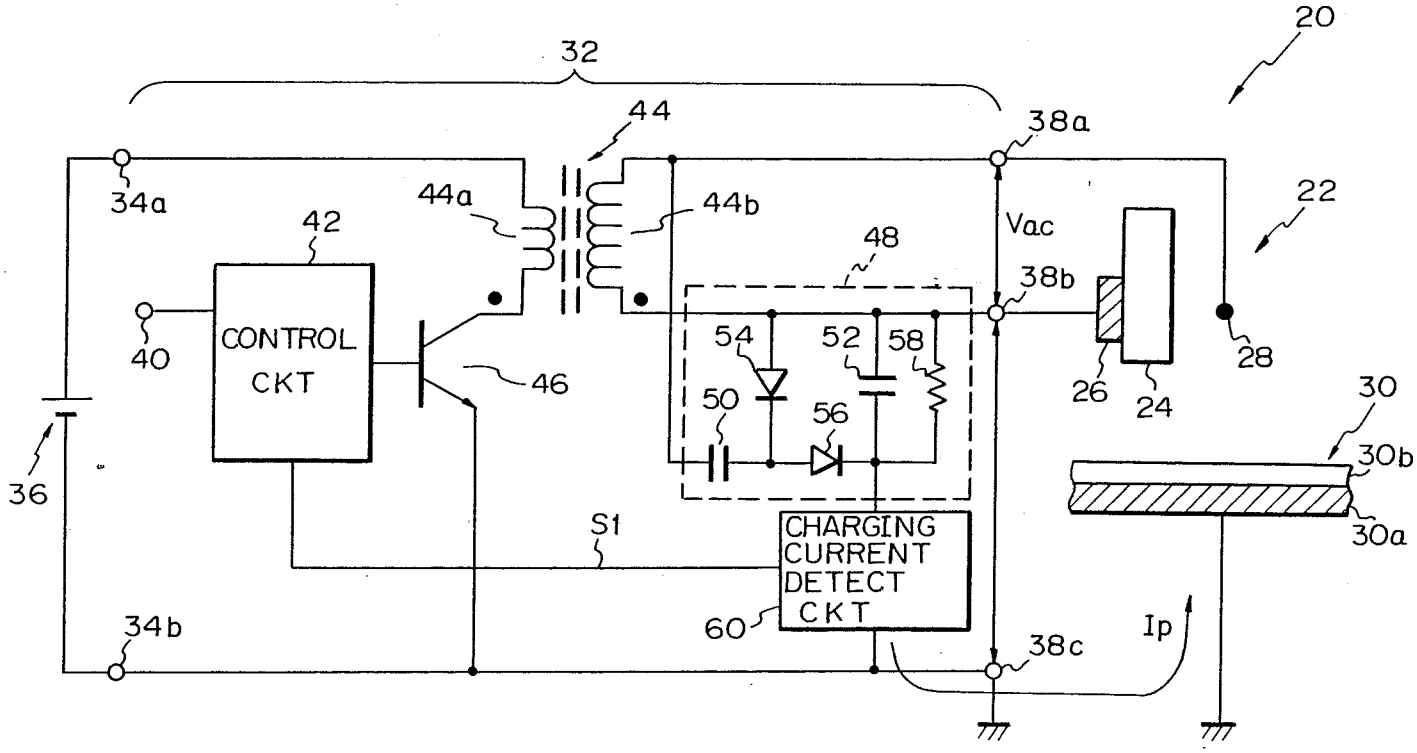
FIG. 2 is a circuit diagram showing a first embodiment of the corona discharging device in accordance with the present invention.

Referring to FIG. 2, a first embodiment of the corona discharging device in accordance with the present invention is shown and generally designated by the reference numeral 20. As shown, the device 20 has a corona discharger 22 which is located in close proximity to a photoconductive element 30. The corona charger 22 is made up of a plate 24 made of a dielectric material, a rear electrode 26 printed on one of opposite major surfaces of the dielectric plate 24, and a corona wire 28 located in the vicinity of the other major surface of the dielectric plate 24. The photoconductive element 30 may be implemented as an OPC drum or an OPC belt which has an OPC layer **30*b* on a conductive base 30*a*. A high-tension power supply 36 has input terminals 34*a* and 34*b* each connecting to a drive power supply 36, an output terminal 38*a* connecting to the corona wire 28, an output terminal 38*b* connecting to the rear electrode 26, an output terminal 38*c* connecting to ground together with the conductive base 30*a* of the photoconductive element 30, and a trigger terminal 40 connecting to a control circuit 42. A boosting transformer 44 has a primary winding 44*a* which is connected at one end to the input terminal 34*a* and at the other end to the collector of a transistor 46. The emitter and the base of the transistor 46 are connected to the input terminal 34*b* and the output terminal of the control circuit 42, respectively. A secondary winding 44*b* of the transformer 44 is connected at one end to the output terminal 38*a* and at the other end to the output terminal 38*b*. A voltage doubler circuit 48 is connected in parallel with the secondary winding 44*b* and made up of capacitors 50 and 52, diodes 54 and 56, and a discharge resistor 58. The output terminal of the voltage doubler 48 is connected to the output terminal 38*c* via a charging current detecting circuit 60. The output of the charging current detecting circuit 60 is fed to the control circuit 42**.

The corona discharging device 20 having the above construction will be operated as follows. When a controller for governing the entire image forming equipment feeds an ON signal to the trigger terminal 40, the control circuit 42 produces switching pulses having a predetermined period to start switching the transistor 46 and thereby to activate the high-tension power supply 32. This turns on and off the current through the primary winding **44*a* of the transformer 44 resulting in a high voltage being induced in the secondary winding 44*b*. As a result, an AC voltage in the form of pulses Vac is applied across the rear electrode 26 and the corona wire 28 of the corona discharger 22. Further, the voltage doubler network 48 produces a negative DC bias voltage Vdc and applies it across the corona wire 28 and the conductive base 30*a* of the photoconductive element 30**.

Figure 3A:
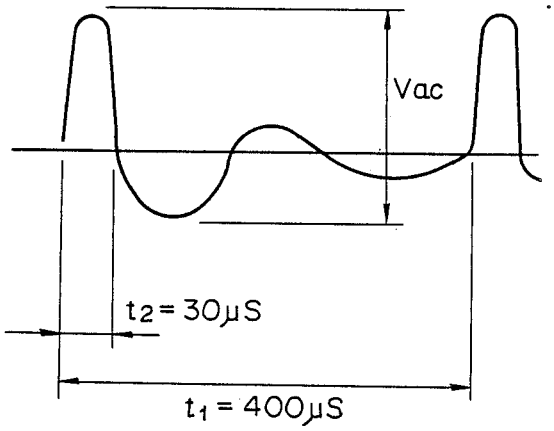
FIGS. 3A and 3B are diagrams each showing a waveform of an output voltage of a high-tension power supply which is included in the device of FIG. 2.
Figure 3B:
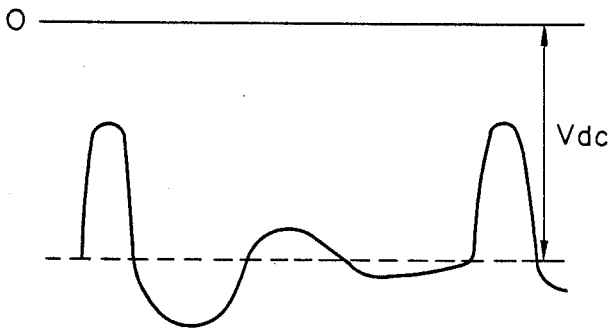

Referring to FIGS. 3A and 3B, the waveform of an output of the high-tension power supply 32 is shown. Specifically, FIGS. 3A and 3B show the waveform of the voltage applied to the corona wire 28 in relation to the rear electrode 26 and the ground for a reference. In the waveform of FIG. 3A representative of the voltage induced in the secondary winding **44*b* of the transformer 44, $t_1$ shows one period of the pulse voltage applied across the rear electrode 26 and the corona wire 28 as previously stated. The period $t_1$ is associated with the switching period of the transistor 46 which drives the primary winding 44*a* and, in this particular embodiment, it is assumed to be 400 microseconds. Further, $t_2$ is associated with the ON time of the transistor 46 and, in the illustrative embodiment, 30 microseconds. During the time $t_2$, a corona discharge occurs mainly around the corona wire 28 so as to produce positive and negative ions. The ions are deposited on the photoconductive element 30 by the DC electric field which is developed between the corona wire 28 and the grounded photoconductive element 30 by the DC bias voltage Vdc shown in FIG. 3B. As a result, the charging current Ip flows through the photoconductive element 30 to charge the OPC layer 30*b* of the element 30** to negative polarity.

The polarity of each winding of the transformer 44 is selected such that the output pulse voltage becomes opposite in polarity to the DC bias voltage Vdc during the period of time $t_2$ in which the pulse voltage is highest, as shown in FIG. 3B. This is to reduce the difference in potential between the corona wire 28 and ground and to thereby eliminate the oscillation of the corona wire 28 otherwise caused by the electrostatic attraction between the wire 28 and ground and the tension of the wire 28. With this configuration, it is possible to increase the service life of the corona wire 28 while eliminating arc discharges.

The charging current detecting circuit 60 detects the charging current Ip of the photoconductive element 30 in the form of a voltage. The output signal $S_1$ of the charging current detecting circuit 60 is fed back to the control circuit 42. In response, the control circuit 42 controls the ON time $t_2$ of the transistor 46 such that the signal $S_1$ is held at a predetermined value, by manipulating the pulse width (duty) of the switching pulses. Consequently, the current Ip maintained constant despite the changes in ambient temperature and humidity, aging, contamination, etc.

Figure 4:
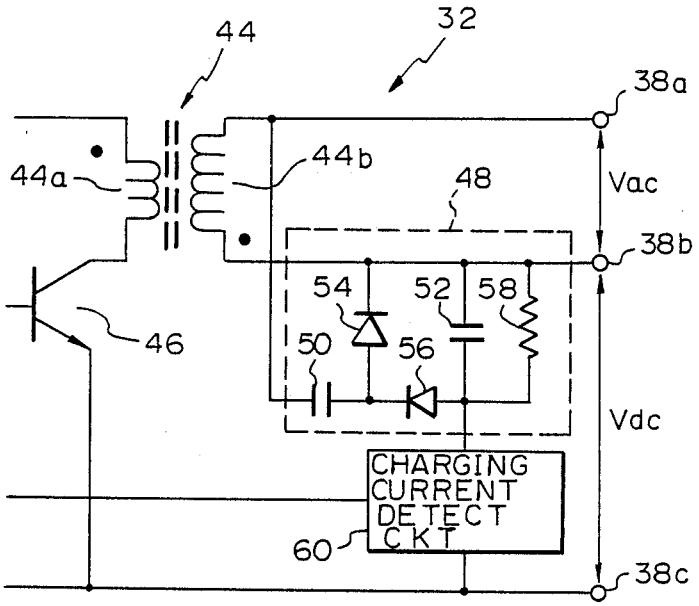
FIG. 4 is a circuit diagram showing an essential part of a high-tension power supply included in a second embodiment of the present invention.

Referring to FIG. 4, there is shown an essential part of a second embodiment of the present invention. In FIG. 4 as well as in the other figures to follow, the same or similar components are designated by like reference numerals, and the rest of the construction is the same as the embodiment of FIG. 2.

Figure 5:
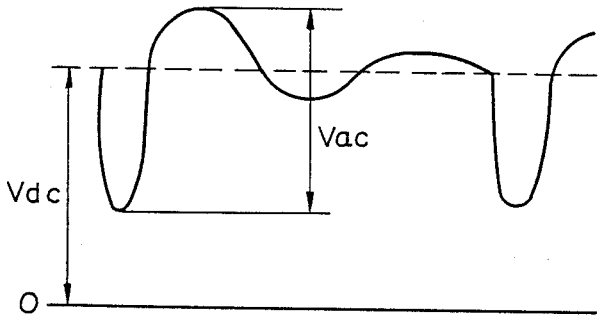
FIG. 5 is a diagram showing an output waveform of the power supply shown in FIG. 4.

The second embodiment is distinguishable from the first embodiment in that it charges the photoconductive element 30 to positive polarity. Specifically, the primary winding **44*a* and secondary winding 44*b* of the boosting transformer 44 are wound in the opposite directions to the windings of the first embodiment. In this configuration, the DC bias voltage Vdc generated by the voltage doubler 48 has a positive polarity with respect to the ground output terminal 38*c*, and the DC bias voltage Vdc and the highest portion of the pulse voltage Vac applied across the output terminals 38*a* and 38*b* are opposite in polarity to each other. Hence, the voltage applied to the corona wire 28 appears as represented by a waveform in FIG. 5**, as viewed with ground as a reference.

Figure 6:
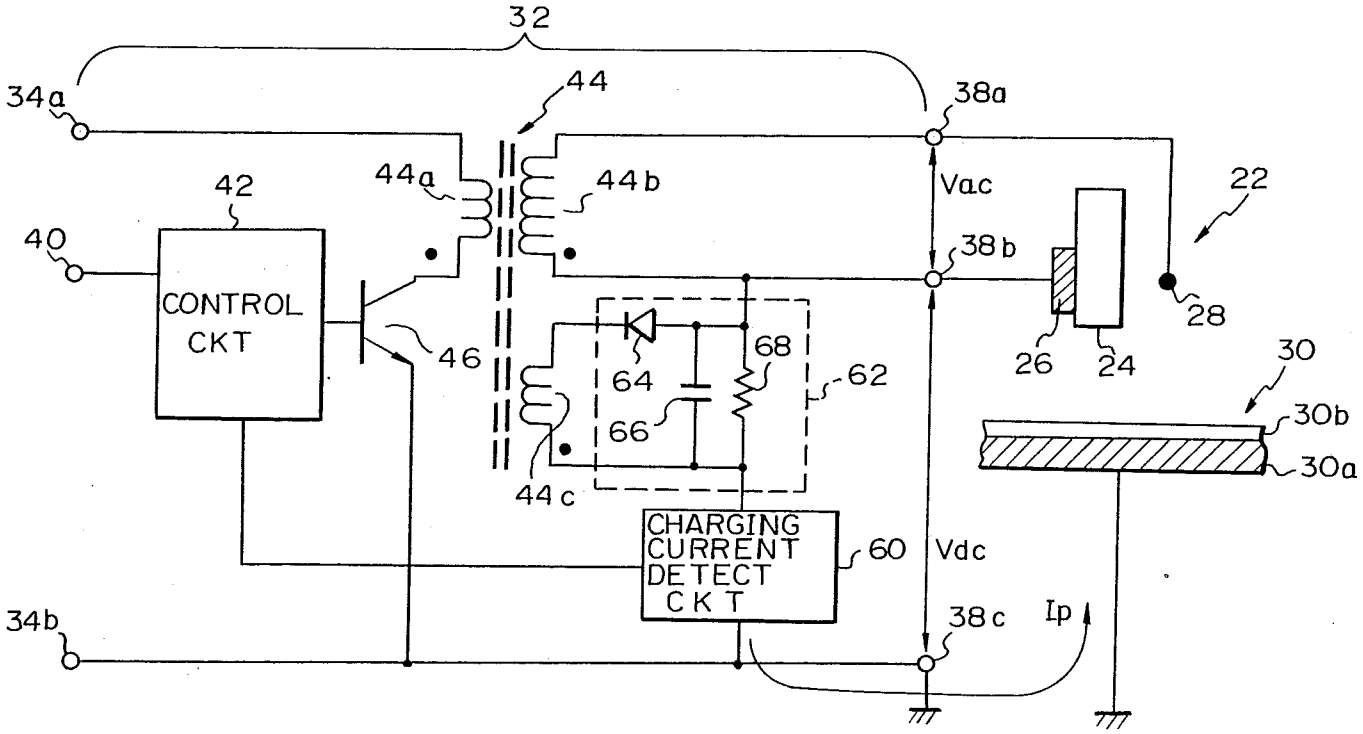
FIG. 6 is a circuit diagram showing a third embodiment of the present invention.

Referring to FIG. 6, a third embodiment of the present invention is shown which differs from the embodiment of FIG. 2 in that the DC bias voltage is generated by an exclusive winding of the boosting transformer 44. As shown, the transformer 44 is provided with a ternary winding 44c while a half-wave rectifier network 62 is connected to the winding 44c. The half-wave rectifier 62 is constituted by a diode 64, a capacitor 66, and a discharge resistor 68. Such circuitry produces the DC bias voltage Vdc having negative polarity. Since the secondary and primary windings 44b and 44a are the same as those of FIG. 2 as to polarity, the pulse voltage Vac and the DC bia voltage Vdc are also opposite in polarity to each other. An advantage attainable with this particular embodiment is that the number of turns of the ternary winding 44c can be selected as desired with no regard to the secondary winding 44b and, therefore, the ratio of the pulse voltage Vac and the DC bias voltage Vdc is open to choice.

Figure 7:
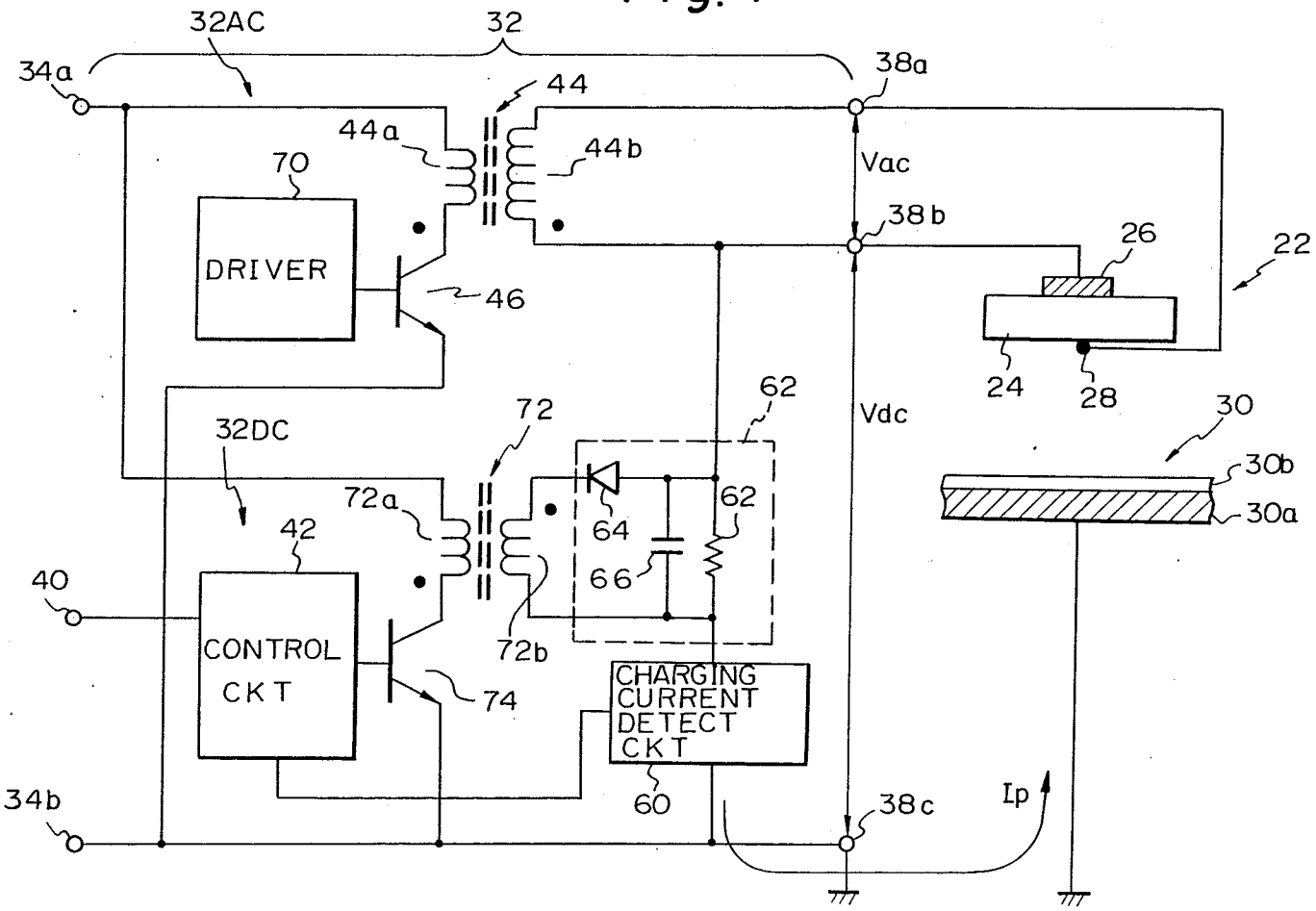
FIG. 7 is a circuit diagram showing a fourth embodiment of the present invention.

FIG. 7 shows a fourth embodiment of the present invention which is essentially similar to the embodiment of FIG. 2 except for a part of the configuration of the corona discharger 22 and high-tension power supply 32. In FIG. 7, the corona wire 28 of the corona discharger 22 is held in contact with the underside of the dielectric plate 24. The high-tension power supply 32 is composed of an AC power supply 32AC and a DC power supply 32DC which produce the pulse voltage Vac and the DC bias voltage Vdc, respectively. The AC power supply 32AC is made up of the transformer 44, the switching transistor 46, and a driver 70 for applying switching pulses having a predetermined pulse width (ON time) to the base of the transistor 46 at a predetermined period. Hence, the pulse voltage Vac appearing across the output terminals 38a and 38b has a constant ON time $t_2$ although it has the same waveform as shown in FIG. 3. The DC power supply 32DC is constituted by a boosting transformer 72, a switching transistor 74, the control circuit 42, and a half-wave rectifier 62 connected to a secondary winding 72b of the transformer 72. The half-wave rectifier 62 has a diode 64, capacitor 66, and a discharge resistor 62. The output of the charging current detecting circuit 60 is fed back to the control circuit 42. In response, the control circuit 42 controls the ON time of the transistor 74 such that the output of the charging current detecting circuit 60 remains constant.

In the construction of FIG. 7, therefore, only the DC bias voltage Vdc is controlled to maintain the charging current Ip constant. Again, the windings of the transformer 44 are wound in such directions that the pulse voltage Vac and the DC bias voltage Vdc are opposite in polarity to each other. Apart from the advantages discussed in relation to the previous embodiments, the embodiment of FIG. 7 is advantageous in that the transistor 74 of the DC power supply 32DC can be provided with a high switching frequency to thereby enhance efficient input-output conversion, because the pulse voltage Vac and the DC bias voltage Vdc are implemented by independent power supplies. In addition, the capacitor 66 can be reduced in size and capacity.

In any of the embodiments described so far, a pulse voltage is applied across the rear electrode 26 and the corona wire 28 to cause a corona discharge, while a DC bias voltage opposite in polarity to the pulse voltage is applied across the corona wire 28 and the photoconductive element 30 to maintain the charging current constant. This is successful in stabilizing the charge potential on the photoconductive element and, yet, in implementing a miniature and durable corona discharging device.

Figure 8:
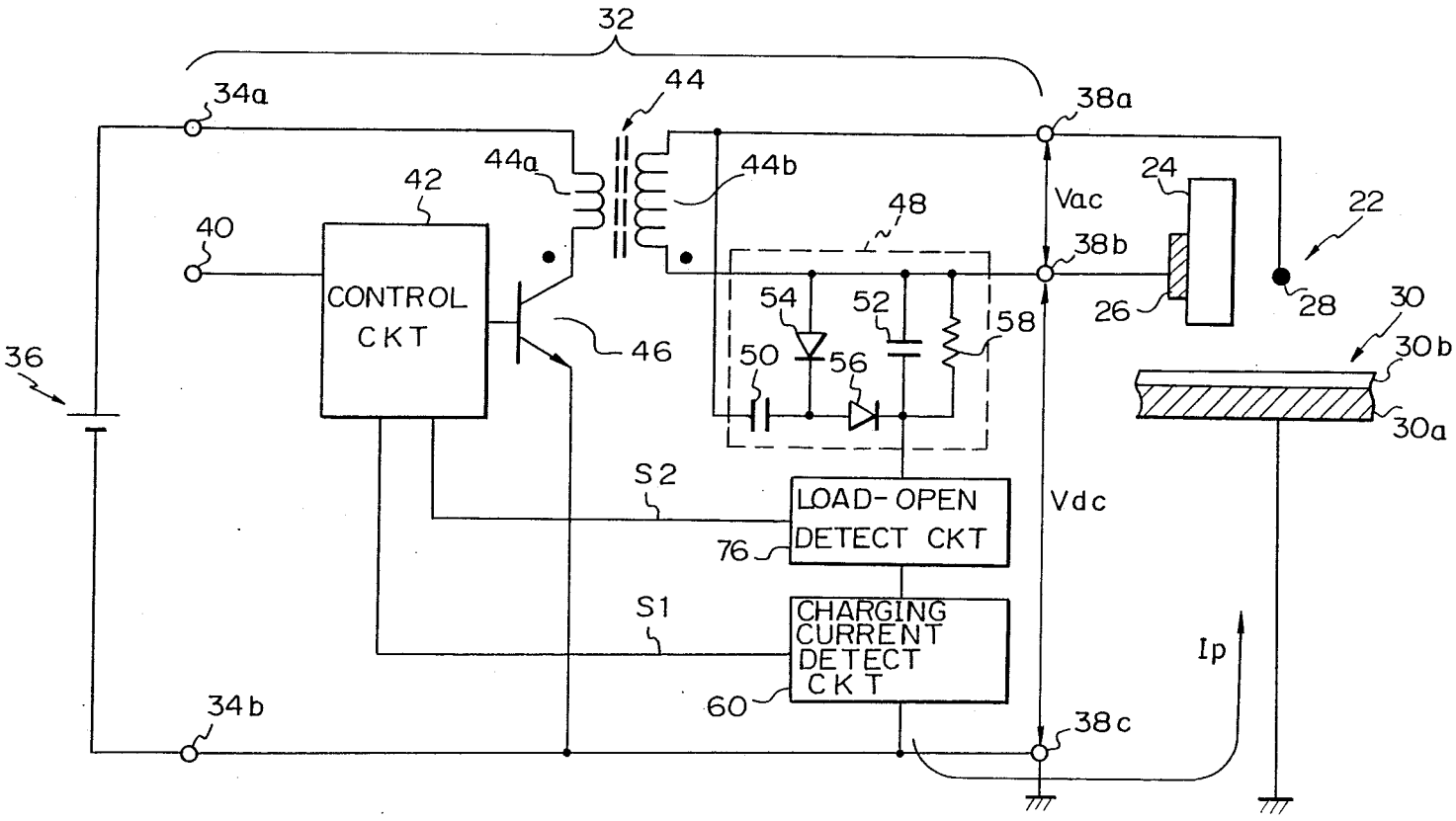
FIG. 8 is a circuit diagram showing a fifth embodiment of the present invention.

Referring to FIG. 8, a fifth embodiment of the present invention is shown which is similar to the embodiment of FIG. 2 except for the following points. Specifically, a load-open detector 76 is connected between the output terminal of the voltage doubler network 48 and the charging current detecting circuit 60. The output signal $S_2$ is fed to the control circuit 42 together with the output signal $S_1$ of the charging current detecting circuit 60.

In FIG. 8, the control circuit 42 controls on ON time of the transistor 46 on the basis of the pulse width (duty) of the switching pulses such that the output signal $S_1$ of the charging current detecting circuit 60 remains constant. Hence, the charge potential on the photoconductive element 30 is maintained constant despite possible changes in the ambient conditions such as temperature and humidity, contamination, etc. The load-open detecting circuit 76 also detects the charging potential Ip at a different level from the charging current detecting circuit 60 and feeds its output to the control circuit 42. When the signal $S_2$ associated with the charging current Ip is lowered below a predetermined value while an ON signal is appearing on the trigger terminal 40, the control circuit 42 determines that the load circuit (corona discharger 22 and photoconductive element 30) is open. Then, the controller 42 interrupts the switching pulses to maintain the transistor 46 turned off. Consequently, the high voltage in the secondary winding 44b of the transformer 44 disappears so that the high-tension power supply 32 stops applying the high voltage across the corona wire 28 and rear electrode 26. When the corona wire 28 and rear electrode 26 are short-circuited, the charging current Ip is also interrupted to in turn interrupt the output of the power supply 32.

Figure 9:
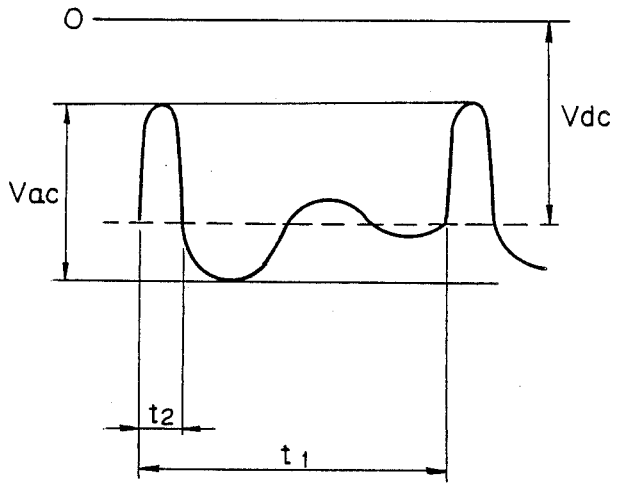
FIG. 9 is a diagram showing a waveform of an output voltage of a high-tension power supply which is included in the embodiment of FIG. 8.

FIG. 9 shows the waveform of the voltage which is applied across the photocondutive element 30 and the corona wire 28. The polarities of the individual windings of the transformer 44 are selected such that the pulse voltage Vac induced in the secondary winding 44b and the DC bias voltage Vdc have polarities which cancel each other, during the time $t_2$ when the transistor 46 is conductive. During one period $t_1$ of the pulse voltage Vac except for the time $t_2$, the waveform oscillates on the basis of the time constants of the transformer 44 and corona discharger 28. Since both of the pulse voltage Vac and DC bias voltage Vdc are produced from the secondary winding 44b of the transformer 44, the feedback for maintaining the charging current Ip constant effects both of them. In this particular embodiment, the charging current detecting circuit 60 and control circuit 42 constitute constant current control means in cooperation, while the load-open detector 76 and control circuit 42 in combination constitute output interrupting means.

Figure 10:
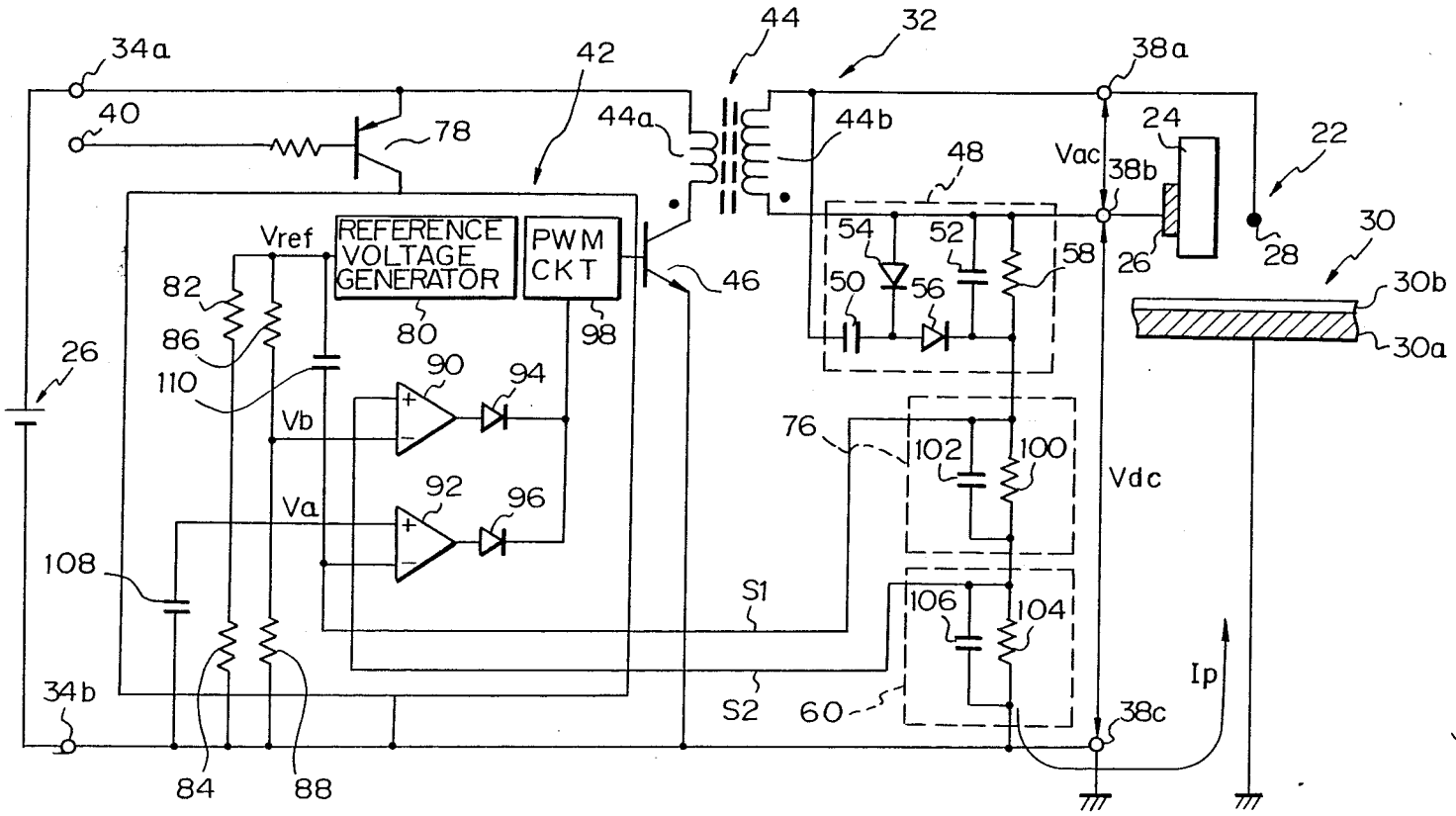
FIG. 10 is a circuit diagram showing a sixth embodiment of the present invention.

Referring to FIG. 10, a sixth embodiment of the present invention is shown in a circuit diagram similar to FIG. 8. In the figure, the components associated with the components of FIG. 8 are designated by the same reference numerals. As shown, the trigger terminal 40 is connected to the base of a transistor 78 which turns on and off the power supply of the control circuit 42. Specifically, the control circuit 42 comprises a voltage divider constituted by resistors 82 and 84, a voltage divider constituted by resistors 86 and 88, a reference voltage generator 80 for generating a reference voltage Vref to be applied to the two voltage dividers, operational amplifiers (OP AMP) 90 and 92 connected to wired OR via diodes 94 and 96, respectively, a pulse width modulation (PWM) circuit 98, etc. A reference voltage Va which the voltage divider 82 and 84 produces by dividing the reference voltage Vref is applied to the non-inverting input of the OP AMP 92, while a reference voltage Vb which the voltage divider 86 and 88 produces by dividing the reference voltage Vref is fed to the inverting input of the OP AMP 90. The load-open detecting circuit 76 is constituted by a parallel connection of a resistor 100 and a capacitor 102. The charging current detecting circuit 60 is connected between the load-open detecting circuit 76 and the ground terminal 38*c* and composed of a parallel connection of a resistor 104 and a capacitor 106. The output $S_2$ of the load-open detecting circuit 76 and the output $S_1$ of the charging current detecting circuit 60 are fed back to the inverting input of the OP AMP 92 and the non-inverting input of the OP AMP 90, respectively.

The operation of the circuiry shown in FIG. 10 is as follows. When an ON signal arrives at the trigger terminal 40, the transistor 78 is rendered conductive to feed power to the control circuit 42. This causes the PWM circuit 98 to produce switching pulses having a predetermined period and thereby starts switching the transistor 46, whereby the high-tension power supply 32 is activated. Consequently, a high voltage is induced in the secondary winding 44*b* of the transformer 44 so that, as in the embodiment of FIG. 2, a high voltage is applied to the corona discharger 22. Hence, a corona discharge occurs between the corona wire 28 and the photoconductive element 30 to cause the charging current Ip to flow through the element 30, resulting in the OPC layer 30*b* of the element 30 being charged. Both of the charging current detecting circuit 60 and load-open detecting circuit 76 detect the current Ip and feed their outputs $S_1$ and $S_2$ to the control circuit 42. In this instance, the control circuit 42 weights the individual signals $S_1$ and $S_2$ on the basis of the reference voltages Va and Vb of the OP AMPs 92 and 90 and the constants of the circuits 60 and 70. Usually, the output of the OP AMP 90 effects the PWM circuit 98 to control the current Ip to the constant value. When the signal $S_2$ which usually has a far higher level than the reference voltage Va becomes lower than the latter due to short-circuiting of the output terminals 38*a* and 38*b*, absence of the photoconductive element 30, or similar cause, the OP AMP 92 turns its output from a low level to a high level. In this condition, the OP AMP 92 effects the PWM circuit 98 prior to the OP AMP 90 to interrupt the switching pulses which are adapted to turn the transistor 46 on and off. Capacitors 108 and 110 are provided to prevent the OP AMP 92 from being activated at the start-up of the power source 32.

Figure 11:
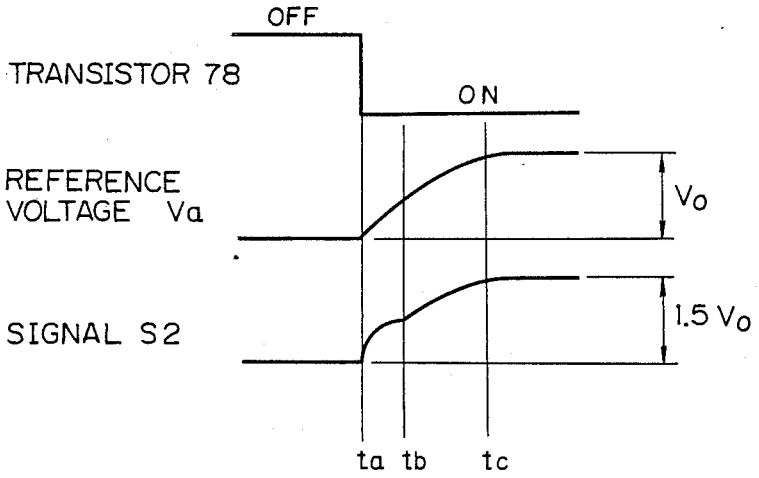
FIG. 11 is a diagram showing waveforms of two different voltages applied to an operational amplifier of the embodiment of FIG. 10 at the start-up of the device.

FIG. 11 shows the waveforms of the reference voltage Va and signal $S_2$ which appear at the beginning of operation. As shown, when the transistor 78 is turned on at a time ta in response to an ON signal which arrives at the trigger terminal 40, the reference voltage Va applied to the non-inverting input of the OP AMP 92 sequentially increases based on the time constants of the resistors 82 and 84 and capacitor 108, as indicated at times tb and tc. On the other hand, since the signal S2 fed to the inverting input of the OP AMP 92 rises faster than the reference voltage Va due to the current stored in the capacitor 110, the output of the OP AMP 92 remains in a low level and therefore does not act on the PWM circuit 98. As a result, the high-tension power supply 32 is activated. While the signal S2 outputted by the load-open detecting circuit 76 is lowered when one or more one of the output terminals 38*a*, 38*b* and 38*c* are short-circuited or open, the high-voltage output is prevented from being interrupted by the discharge of the capacitors 102 and 106 if the duration of such a drop of the signal S2 is short.

As stated above, in this particular embodiment, a pulse voltage is applied across the corona wire 28 and the rear electrode 26, while a DC bias voltage is applied across the photoconductive element 30 and the corona wire 28. This controls the current for charging the photoconductive element 30 to a constant value. When the charging current is lower than a predetermined value, the high-tension power supply 32 is prevented from outputting a high voltage so as to interrupt the corona discharge. Hence, the photoconductive element 30 is uniformly charged at all times and, yet, the fear of electrical shock and arc discharge is eliminated even in unusual conditions such as the absence of the photoconductive element 30 in the equipment.

In the embodiments described above, the corona wire 28 is located in the vicinity of that surface of the dielectric plate 24 which is opposite to the surface where the rear electrode 26 is provided. Alternatively, the corona wire 28 may be held in contact with the surface of the dielectric plate 24.

Hereinafter will be described alternative embodiments of the present invention which are also constructed to guarantee safety operations even when the output is open (absence of the photoconductive element 30), with reference to FIGS. 12 to 15.

In the fifth and sixth embodiments shown in FIGS. 8 and 10, respectively, an arrangement is made to deactivate the high-tension power supply 32 when the charging current is lowered beyond a predetermined value. Each of the embodiments which will be described senses the DC bias voltage Vdc and, when it is increased beyond a predetermined value or decreased beyond another predetermined value, deactivates the power supply 32. This is to cope with an occurrence that the charging current Ip decreases and the DC bias voltage increases, and an occurrence that the DC bias voltage Vdc decreases with the charging current remaining the same. The first- and second-mentioned occurrences are sometimes observed when the output is open (absence of the photoconductive element 30, for example) and when the output is short-circuited, respectively.

Figure 12:
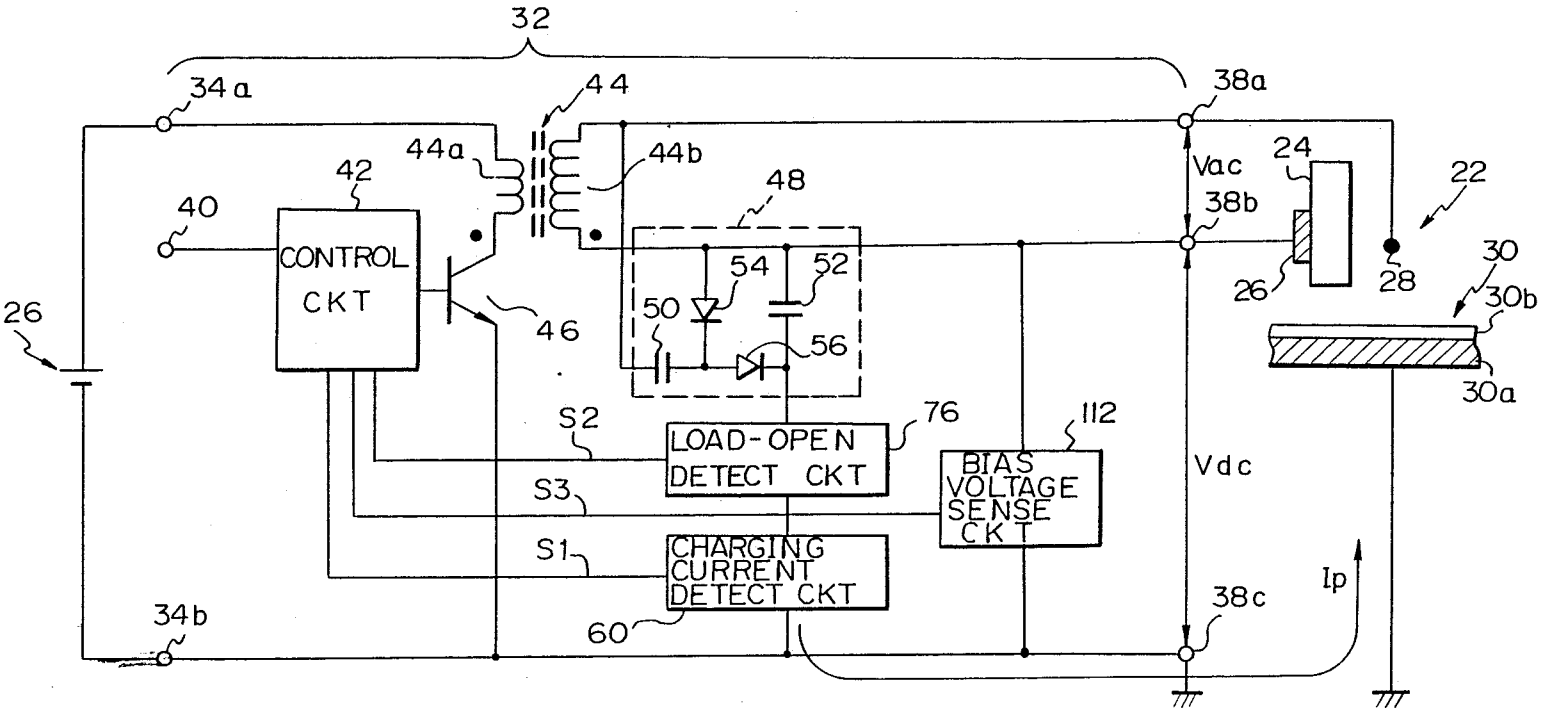
FIG. 12 is a circuit diagram showing a seventh embodiment of the present invention.

Referring to FIG. 12, an eighth embodiment of the present invention is shown which is essentially similar to the embodiment of FIG. 8 except for the addition of a bias voltage sensing circuit 112 and some extra functions assigned to the control circuit 42. The bias voltage sensing circuit 112 senses the DC bias voltage Vdc being outputted by the voltage doubler 48, feeding back a signal $S_3$ representative of the voltage Vdc to the control circuit 42. When the signal $S_3$ rises above a first predetermined value (comparatively large value), i.e., when the DC bias voltage rises beyond a predetermined level (comparatively high level), the control circuit 42 determines that the load circuit is open and then interrupts the delivery of switching pulses to the transistor 46 to maintain the transistor 46 non-conductive. This prevents the pulse voltage Vac from being fed to the corona wire 28 and rear electrode 26. Further, when the output signal $S_3$ of the bias voltage sensing circuit 112 is lowered beyond a second predetermined value (comparatively low value), i.e., when the DC bias voltage Vdc is lowered beyond a predetermined level (comparatively low level), the control circuit 42 determines that the load circuit is open and then interrupts the delivery of switching pulses to the transistor 46. In this case, too, the pulse voltage Vac is prevented from being applied to the corona wire 28 and rear electrode 26.

Figure 13:
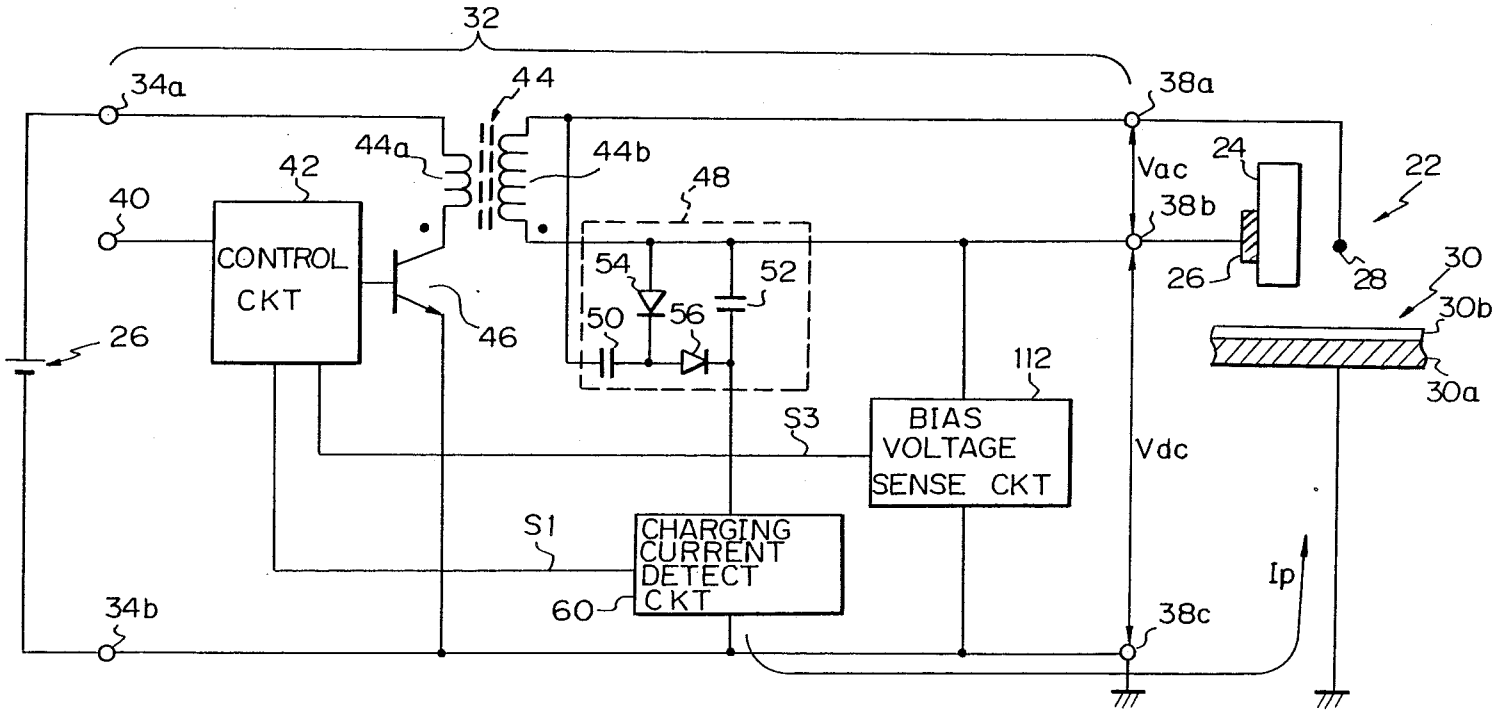
FIG. 13 is a circuit diagram showing an eighth embodiment of the present invention.

FIG. 13 shows an eight embodiment in which the load-open detecting circuit 76 of the seventh embodiment is omitted. The rest of the construction and arrangement of the FIG. 13 embodiment is the same as the seventh embodiment, and details thereof will not be described to avoid redundancy.

Figure 14:
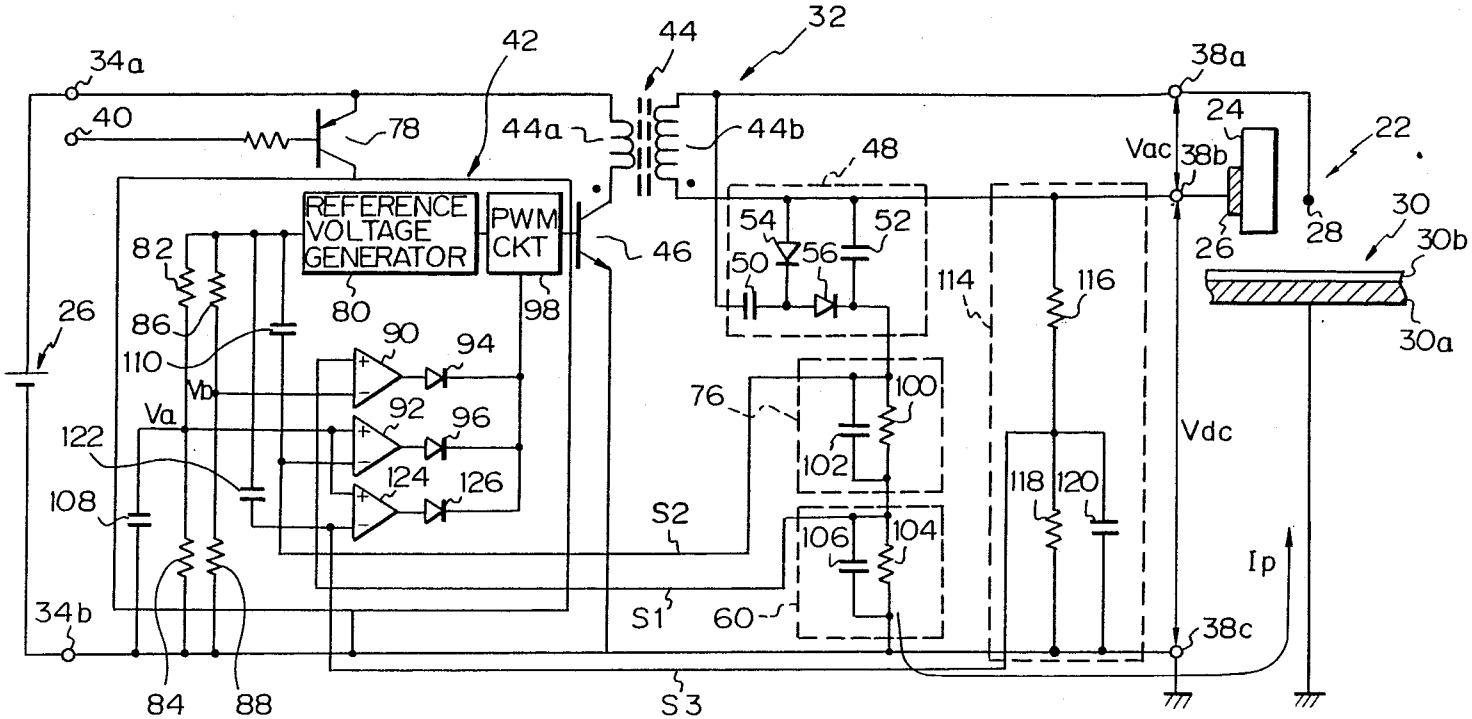
FIG. 14 is a circuit diagram showing a ninth embodiment of the present invention.

FIG. 14 shows a ninth embodiment which is essentially similar to the sixth embodiment of FIG. 10 except for some modifications. Specifically, this particular embodiment additionally includes a bias voltage sensing circuit 114 which is made up of resistors 116 and 118 and a capacitor 120. The control circuit 42 is additionally provided with a capacitor 122, an OP AMP 124, and a diode 126. When the signal $S_3$ produced by the resistors 116 and 118 of the bias voltage sensing circuit 114 by dividing the DC bias voltage Vdc is lowered below the reference voltage Va, the output of the OP AMP 124 turns from low to high to render the diode 126 conductive. This causes the PWM circuit 98 to stop delivering the switching pulses and thereby interrupts the pulse voltage Vac.

Figure 15:
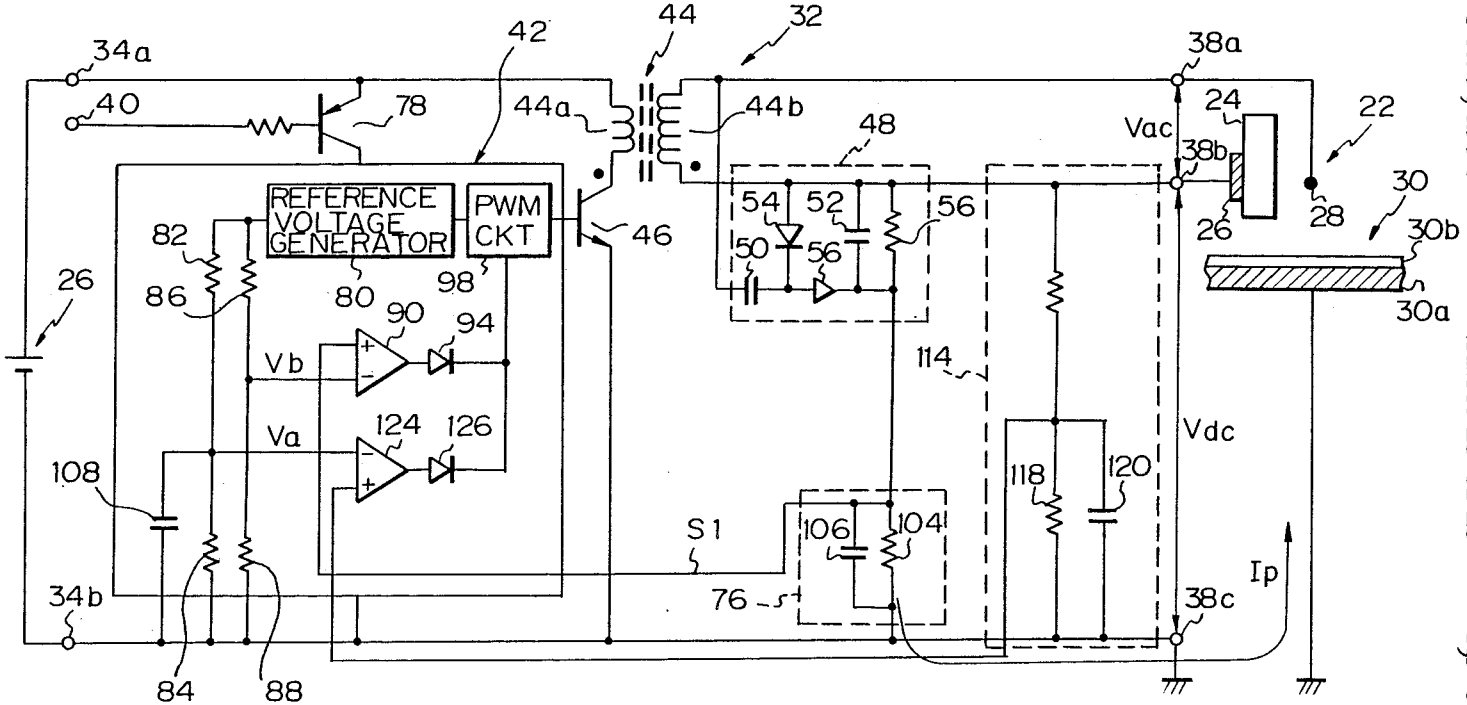
FIG. 15 is a circuit diagram showing a tenth embodiment of the present invention.

FIG. 15 shows a tenth embodiment which lacks the capacitor 122 of the control circuit 42 of the embodiment shown in FIG. 14 and has the non-inverting and inverting inputs of the OP AMP 124 replaced with each other. In this alternative configuration, the high voltage is interrupted when the DC bias voltage Vdc rises above a predetermined level. In this particular embodiment, the load-open detecting circuit 76 and the OP AMP 92 and diode 96 of the control circuit 32 of the ninth embodiment are also omitted.

It will be seen that the embodiments described above are also capable of eliminating the fear of electrical shock and arc discharge even when one forgets to mount the photoconductive element or when the electrodes are short-circuited.

Various modifications will become possible for those skilled in the art after receiving the teachings of the present disclosure without departing from the scope thereof.

What is claimed is:

1. A corona discharging device for image forming equipment having an image carrier, comprising:

a corona discharger located in close proximity to said image carrier and comprising a dielectric plate, a rear electrode positioned at one side of said dielectric plate, and a corona wire positioned at the other side of said dielectric plate; and a high-tension power supply for applying a DC bias voltage across said rear electrode and said image carrier and applying a pulse voltage which is opposite in polarity to the DC bias voltage across said rear electrode and said corona wire.

2. A device as claimed in claim 1, wherein said high-tension power supply comprises constant current control means for controlling a charging current for charging said image carrier to a predetermined constant current, and high voltage interrupting means for preventing a high voltage from being applied to said corona wire and said rear electrode when the charging current is lowered below a predetermined value.

3. A device as claimed in claim 1, further comprising:

bias voltage sensing means for sensing the DC bias voltage; and high voltage interrupting means for preventing a high voltage from being applied to said corona wire and said rear electrode when the DC bias voltage being sensed by said bias voltage sensing means is increased above a predetermined value.

4. A device as claimed in claim 2, further comprising bias voltage sensing means for sensing the DC bias voltage, said high voltage interrupting means further preventing a high voltage from being applied to said corona wire and said rear electrode when the DC bias voltage being sensed by said bias voltage sensing means is increased above a predetermined value.

5. A device as claimed in claim 2, wherein said high voltage interrupting means comprises a load open detection circuit.

6. A corona discharging device for image forming equipment having an image carrier, comprising:

a corona discharger located in close proximity to said image carrier and comprising a dielectric plate, a rear electrode positioned at one side of said dielectric plate, and a corona wire positioned at the other side of said dielectric plate;

a high-tension power supply for applying a DC bias voltage across said corona wire and said image carrier and applying a pulse voltage which is opposite in polarity to the DC bias voltage across said rear electrode and said corona wire; and control circuit means for controlling the application of the pulse voltage to said corona discharger.

7. A device as claimed in claim 6, wherein said high-tension power supply comprises:

constant current control means for controlling a charging current for charging said image carrier to a predetermined constant current, and high voltage interrupting means for preventing a high voltage from being applied to said corona wire and said rear electrode when the charging current is lowered below a predetermined value.

8. A device as claimed in claim 6, further comprising:

bias voltage sensing means for sensing the DC bias voltage; and high voltage interrupting means for preventing a high voltage from being applied to said corona and said rear electrode when the DC bias voltage being sensed by said bias voltage sensing means is increased above a predetermined value.

9. A device as claimed in claim 7, further comprising:

bias voltage means for sensing the DC bias voltage, said high voltage interrupting means further preventing a high voltage from being applied to said corona wire and said rear electrode when the DC bias voltage being sensed by said bias voltage sensing means is increased above a predetermined value.

10. A device as claimed in claim 7, wherein said high voltage interrupting means comprises a load open detection circuit.

* * * * *